US005375574A

United States Patent [19]

Tomisawa et al.

[11] Patent Number: 5,375,574

[45] Date of Patent: Dec. 27, 1994

[54] ENGINE IDLING SPEED CONTROL APPARATUS

[75] Inventors: Naoki Tomisawa; Satoru Watanabe, both of Atsugi, Japan

[73] Assignee: Unisia Jecs Corporation, Atsugi, Japan

[21] Appl. No.: 107,892

[22] Filed: Aug. 18, 1993

[51] Int. Cl.[5] ..... F02M 3/00; F02M 3/06

[52] U.S. Cl. ..... 123/339

[58] Field of Search ..... 123/339

[56] References Cited

U.S. PATENT DOCUMENTS

| | | | |
|---|---|---|---|
| 4,877,003 | 10/1989 | Shimomura et al. | 123/339 |
| 5,065,717 | 11/1991 | Hosokai et al. | 123/339 |
| 5,146,888 | 9/1992 | Sawamoto | 123/339 |
| 5,216,610 | 6/1993 | Douta et al. | 123/339 |
| 5,235,946 | 8/1993 | Fodale et al. | 123/339 |
| 5,249,558 | 10/1993 | Imamura | 123/339 |
| 5,269,272 | 12/1993 | Nakaniwa | 123/339 |

FOREIGN PATENT DOCUMENTS

| | | |
|---|---|---|
| 4141655 | 7/1992 | Germany . |
| 1-179148 | 12/1989 | Japan . |

*Primary Examiner*—David A. Okonsky
*Attorney, Agent, or Firm*—Foley & Lardner

[57] ABSTRACT

An apparatus for controlling the engine idling speed to a target value. The apparatus is arranged to calculate a basic engine output torque required to maintain the engine idling speed at a target value, and a required engine output torque change required to change the engine speed to a changed target engine idling speed value. A required engine output torque is calculated based upon the sum of the calculated basic engine output torque and a torque value corresponding to a deviation of a sensed engine output torque change from the required engine output torque change. The required engine output torque is used to control the amount of air permitted to enter the engine when the engine is idling.

5 Claims, 4 Drawing Sheets

ENGINE IDLING SPEED CONTROL APPARATUS

BACKGROUND OF THE INVENTION

This invention relates to an engine idling speed control apparatus for controlling the amount of air permitted to enter the engine so as to maintain the engine speed at a target value when the engine is idling.

For example, Japanese Utility Model Kokai No. 1-179148 discloses an engine idling speed control apparatus which includes an auxiliary air control valve provided in an auxiliary air passage bypassing a throttle valve situated within an engine induction passage. The engine idling speed control apparatus is arranged to change the duty factor of an electrical pulse signal applied to operate the auxiliary air control valve when the engine is idling. The duty factor change is made in a manner to provide a feedback control correcting the air flow through the auxiliary air passage to maintain the engine idling speed at a target value. The duty factor $ISC_{ON}$ is calculated as $ISC_{ON}=ISC_{TW}+ISC_{CL}$ where $ISCT_{TW}$ is a basic control factor calculated as a function of engine coolant temperature TW and $ISC_{CL}$ is a feedback correction factor containing integral plus proportional terms generated in response to the sensed deviation of the actual engine speed $N_e$ from the target value $N_{SET}$. For example, when an external load is produced to decrease the actual engine speed $N_e$, it is required to increase the duty factor $ISC_{ON}$ so as to zero the deviation of the actual engine speed $N_e$ from the target engine idling speed value $N_{SET}$. Since the conventional engine idling speed control apparatus is arranged to increase the duty factor gradually while monitoring the engine speed change, however, it requires much time to zero the deviation and has a slow response.

SUMMARY OF THE INVENTION

It is a main object of the invention to provide an improved engine idling speed control apparatus which has a fast response to an external load change and also to a target engine idling speed change.

There is provided, in accordance with the invention, an apparatus for controlling the idling speed of an internal combustion engine including a throttle valve provided in an induction passage for controlling the amount of air flow through the induction passage, and an auxiliary air control valve provided in an auxiliary air passage bypassing the throttle valve for controlling the amount of air flow through the auxiliary air passage. The apparatus comprises sensor means sensitive to engine speed for producing an electrical signal indicative of a sensed engine speed, means for calculating a target value for engine idling speed as a function of engine temperature, means for calculating a basic engine output torque required to maintain the engine speed at the calculated target value, means for calculating a required engine output torque change required to change the engine speed to a changed target engine idling speed value, means for detecting an actual engine output torque change, means for calculating a required engine output torque based upon a sum of the calculated basic engine output torque and a torque value corresponding to a difference between the required engine output torque change and the detected actual engine output torque change, means for converting the required engine output torque in to a corresponding amount of air flow through the auxiliary air passage, and means for controlling the auxiliary air control valve to permit the converted amount of air to flow through the auxiliary air passage.

BRIEF DESCRIPTION OF THE DRAWINGS

This invention will be described in greater detail by reference to the following description taken in connection with the accompanying drawings, in which.

DETAILED DESCRIPTION OF THE INVENTION

Figure 1:
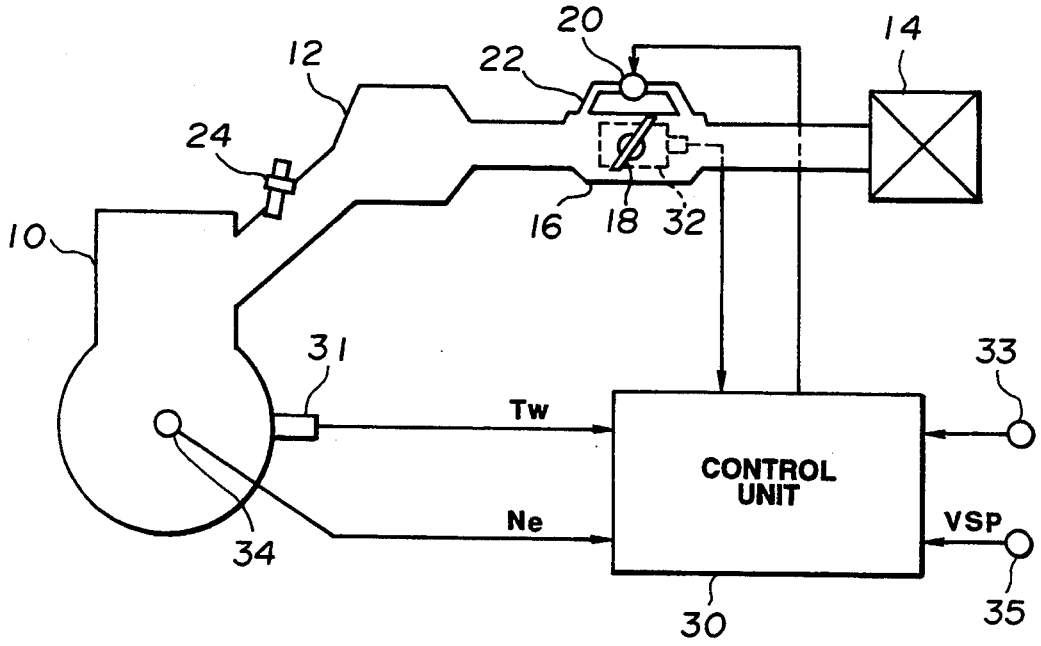
FIG. 1 is a schematic diagram showing one embodiment of an engine idling speed control apparatus made in accordance with the invention.

With reference to the drawings and in particular to FIG. 1, there is shown a schematic diagram of an engine idling speed control apparatus embodying the invention. An internal combustion engine, generally designated by the numeral 10, for an automotive vehicle includes combustion chambers or cylinders connected to an intake manifold 12.

Air to the engine 10 is supplied through an air cleaner 14 into an induction passage 16. The amount of air permitted to enter the combustion chambers through the intake manifold 12 is controlled by a butterfly throttle valve 18 situated within the induction passage 16. The throttle valve 18 is connected by a mechanical linkage to an accelerator pedal (not shown). The degree to which the accelerator pedal is depressed controls the degree of rotation of the throttle valve 18. An auxiliary air control valve 20 is provided in an auxiliary air passage 22 bypassing the throttle valve 18 to control the amount of air introduced into the in take manifold 12 at idling conditions where the throttle valve 18 is at its closed position. Thee auxiliary air control valve 20 opens to permit air flow through the auxiliary air passage 22 when it is energized by the presence of an electrical pulse signal. The duty factor of the electrical pulse, that is, the ratio of the pulse-width to the repetitive period, applied to the auxiliary air control valve 20 determines the length of time the auxiliary air control valve 20 opens during the repetitive period and, thus, determines the amount of air flow into the intake manifold 12. A fuel injector 24 is positioned to inject a controlled amount of fuel into the intake manifold 12. In the operation of the engine 10, fuel is injected intermittently in synchronism with rotation of the engine 10 through the fuel injector 24 into the intake manifold 12 and mixed with the air therein.

The amount of air metered through the auxiliary air passage 22 into the intake manifold 12, this being determined by the duty factor of the electrical pulse signal applied to the auxiliary air control valve 20, is repetitively determined from calculations performed in a control unit 30. These calculations are made based upon various conditions of the engine 10 that are sensed during its operation. These sensed conditions include engine coolant temperature Tw, throttle valve position, transmission gear position, engine speed $N_e$ and vehicle speed VSP. Thus, an engine coolant temperature sensor 31, an idle switch 32, a neutral switch 33, a reference pulse generator 34 and a vehicle speed sensor 35 are connected to the control unit 30.

The engine coolant temperature sensor 31 preferably is mounted in the engine cooling system and comprises a thermistor connected in an electrical circuit capable of producing a DC voltage having a variable level proportional to engine coolant temperature. The idle switch 32 is responsive to the idling (or closed) position of the throttle valve 18 for closing to supply current from the car battery to the control unit 30. The neutral switch 33 is responsive to the position of the transmission gear in neutral for closing to supply current from the car battery to the control unit 30. The reference pulse generator 34 is associated with the engine crankshaft for producing a series of reference electrical pulses REF, each corresponding to a predetermined number of degrees (for example, 360° in the case of a 4-cycle engine) of rotation of the engine crankshaft, of a repetition period $T_{REF}$ inversely proportional to engine speed. The reference electrical pulses REF are converted into a corresponding signal indicative of engine speed $N_e$. The vehicle speed sensor 35 produces an electrical signal corresponding to the speed VSP of running of the automotive vehicle.

The control unit 30 may employ a digital computer which includes a central processing unit (CPU), a random access memory (RAM), a read only memory (ROM), and an input/output control circuit (I/O). The central processing unit communicates with the rest of the computer via data bus. The input/output control circuit includes an analog-to-digital converter which converts the analog signals received from the various sensors into digital form for application to the central processing unit. The read only memory contains the program for operating the central processing unit and further contains appropriate data in look-up table used in calculating an appropriate value for the duty factor of the electrical pulse signal applied to the idling control valve 20. The look-up data may be obtained experimentally or derived empirically. The central processing unit may be programmed in a known manner to interpolate between the data at different entry points if desired.

Figure 2:
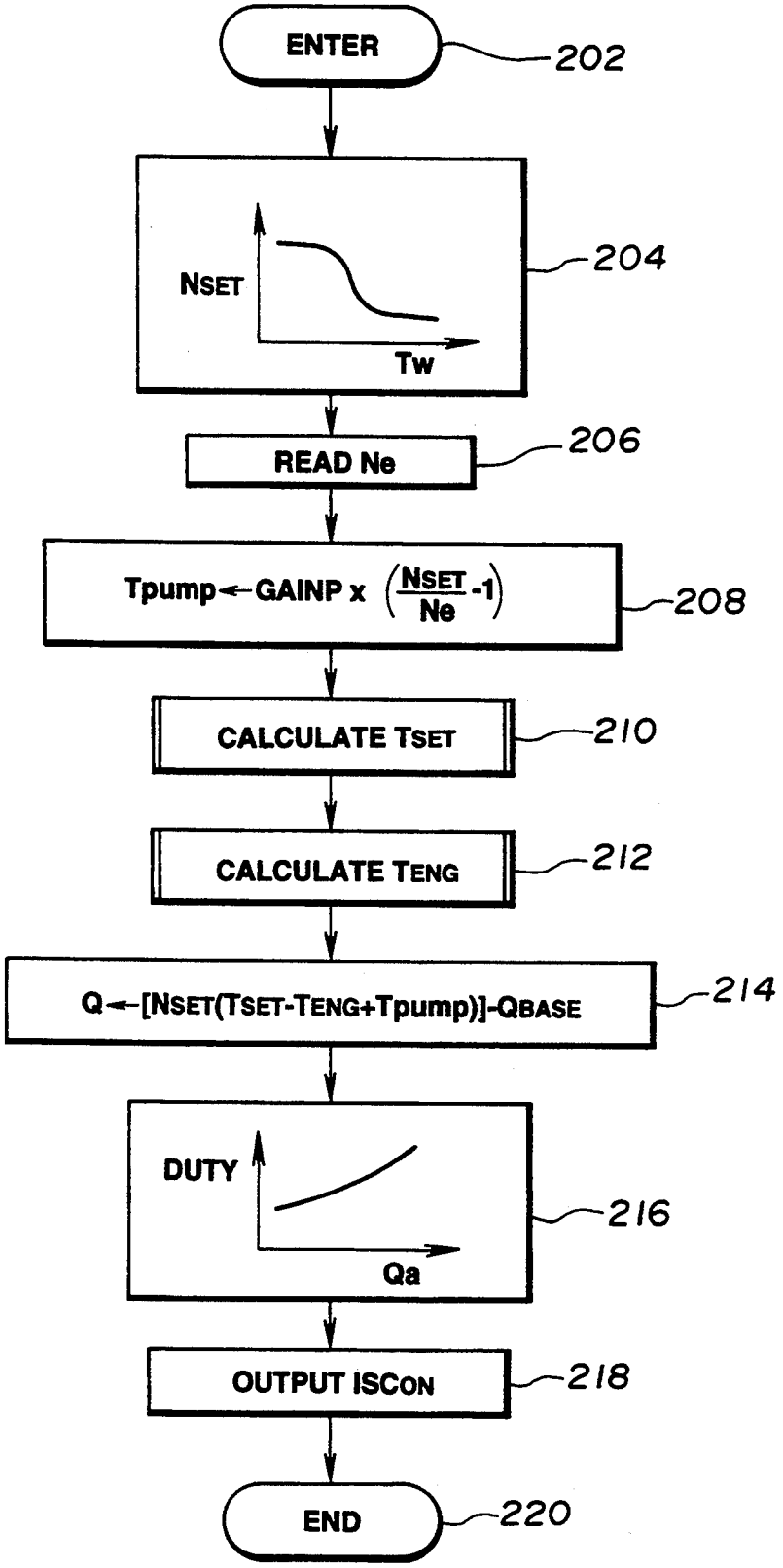
FIG. 2 is a flow diagram showing the programming of the digital computer used to operate the auxiliary air control valve.

FIG. 2 is an overall flow diagram illustrating the programming of the digital computer as it is used to control the engine idling speed. The computer program is entered at the point 202 in response to a reference electrical pulse REF produced from the reference pulse generator 34 only when a idling speed control condition is fulfilled, that is, when the idle switch 32 is closed (ON) and the neutral switch 33 is closed (ON), or when the idle switch 32 is closed (ON) and the vehicle speed VSP is less than a predetermined value (for example, 8 km/h). At the point 204 in the program. the central processing unit calculates a target value $N_{SET}$ for the engine idling speed. For this purpose, the central processing unit looks a t the target engine idling speed value $N_{SET}$ in a look-up table which defines the target value $N_{SET}$ as a function of engine coolant temperature Tw, as shown in the block 204 of FIG. 2. At the point 206 in the program, the actual or sensed engine speed $N_e$ is read into the computer memory. At the point 208 in the program, a basic engine output torque $T_{pump}$ required to retain the engine idling speed at the target value $N_{SET}$ is calculated as $T_{pump}=GAINP\times(-N_{SET}/N_e-1)$, where GAINP is a constant used to convert the engine speed change into a corresponding engine output torque. The basic engine output torque $T_{pump}$ corresponds to the auxiliary air amount required to return the engine idling speed to the target value while retaining the engine output torque when the engine idling speed changes. That is, the basic engine output torque $T_{pump}$ corresponds to the external load produced to change the engine speed $N_e$ from the target value $N_{SET}$. The engine output torque T is given as $T=K\times Q/N$ where K is a constant and Q is the intake air flow, that is, the amount of air permitted to enter the engine. Assuming now that the intake air flow Q is constant, the engine output torque $T_m$ produced at an engine speed $N_m$ is calculated as $Tm=K\times Q/N_m$ and the engine output torque $T_e$ produced at an engine speed $N_e$ is calculated as $T_e=K\times Q/N_e$. Thus, $T_m\cdot N_m=T_e\cdot N_e$ and $T_e=T_m\cdot N_m/N_e$. Consequently, the engine output torque change made when the engine speed changes from $N_m$ to $N_e$ for the same intake air flow Q is calculated as $T_m-T_e=T_m\cdot(1-N_m/N_e)$. For example, when the engine speed decreases, the engine output torque increases and, thus, $T_m<T_e$. It is, therefore, possible to increase the engine speed to the initial value $N_m$ while retaining this engine output torque by increasing the intake air flow Q by an amount corresponding to the torque $-T_m\cdot(1-N_m/N_e)=T_m\cdot(N_m/N_e-1)$. If the vehicle speed $N_m$ is replaced with the target engine idling speed value $N_{SET}$, the basic engine output torque $T_{pump}$ is given as a torque directly proportional to $(N_{SET}/N_e-1)$.

At the point 210 in the program, a required engine output torque change $T_{SET}$ is calculated. This engine output torque change $T_{SET}$ is required to change the engine speed to a changed target engine idling speed value $N_{SET}$, that is, to follow a change in the target engine idling speed value change. At the point 212 in the program, the actual engine output torque change $T_{ENG}$ is calculated. At the point 214 in the program, the central processing unit calculates a required auxiliary air amount $Q_a$, that is, the amount $Q_a$ of air to be introduced through the auxiliary air passage 22 to the engine as $Q_a=[N_{SET}\cdot(T_{SET}-T_{ENG}+T_{pump})-Q_{BASE}$ where $N_{SET}$ is the new target idling speed value, $(T_{SET}-T_{ENG}+T_{pump})$ is the required engine output torque, and $Q_{BASE}$ is the amount of air leaked around the throttle valve 18. For example, when $T_{SET}>T_{ENG}$, the engine output torque is insufficient by the difference $T_{SET}-T_{ENG}$. For this reason, the engine speed change has a slow response. In order to compensate for the shortage of the engine output torque, the required engine output torque is obtained by adding $(T_{SET}-T_{ENG})$ to the basic engine output torque $T_{pump}$.

At the point 216 in the program, the central processing unit looks at the duty factor DUTY of the electrical pulse signal applied to the auxiliary air control valve 20 in a look-up table which defines the duty factor DUTY as a function of required auxiliary air amount Q. At the point 218 in the program, the calculated duty factor DUTY is transferred by the central processing unit to the input/output control circuit which thereby produces an electrical pulse signal to operate the auxiliary air control valve 20 with a duty factor corresponding to the value DUTY calculated by the computer. Following this, the program proceeds to the end point 220.

Figure 3:
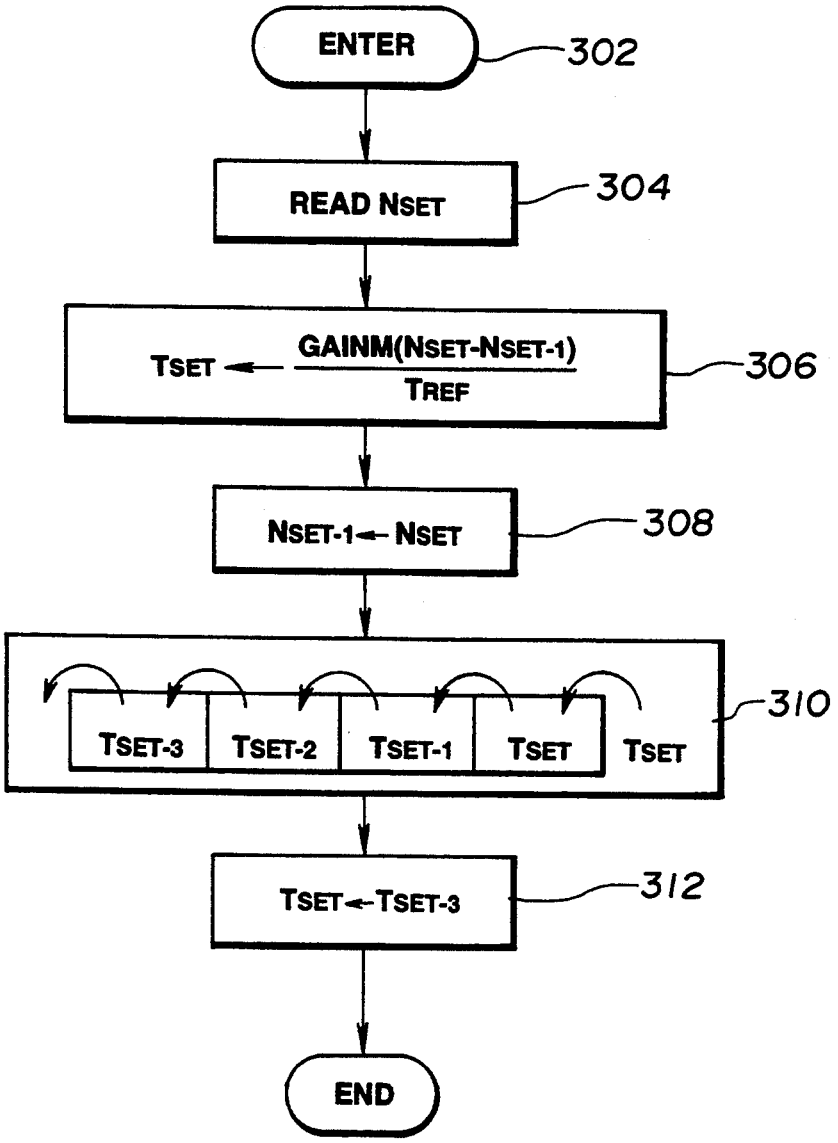
FIG. 3 is a detailed flow diagram showing the programming of the digital computer as it is used to calculate required engine output torque change.

FIG. 3 is a flow diagram illustrating the above calculation of required engine output torque change $T_{SET}$. At the point 302, which corresponds to the point 210 of FIG. 2, the computer program is entered. At the point 304 in the program, the target idling speed value $N_{SET}$ is read into the computer memory. At the point 306 in the program, the central processing unit calculates a required engine output torque change $T_{SET}$ required to change the engine speed from the last target idling speed value $N_{SET-1}$ to the new target idling speed value $N_{SET}$ as $T_{SET}=\{GAINM\cdot(N_{SET}-N_{SET-1}\}/T_{REF}$, where GAINM is a constant used to convert the engine speed change into a corresponding torque, and $T_{REF}$ is the repetition period of the reference electrical pulses REF. The last target idling speed value $N_{SET-1}$ is the target idling speed value sampled or read at the point 304 in the last cycle of execution of the program and the new target idling speed value $N_{SET}$ is the target idling speed value sampled or read at the point 304 in the present cycle of execution of the program. Thus, the required torque change $T_{SET}$ is a required engine output torque change per unit time.

A t the point 308 in the program, the new target idling speed value $N_{SET}$ is used to update the last target idling speed value $N_{SET-1}$ for the calculation of required engine output torque change $T_{SET}$ in the next cycle of execution of the program. At the point 310 in the program, the new engine output torque change value $T_{SET}$ is stored in the computer memory. The old engine output torque change value are used to update the respective older engine output torque values so that the computer memory stores one new engine output torque change value $T_{SET}$ and three old engine output torque change values $T_{SET-1}$, $T_{SET-2}$ and $T_{SET-3}$. At the point 312 in the program, the oldest required engine output torque change value $T_{SET-3}$ is read from the computer memory and set as the required torque change $T_{SET}$. The reason why the lest required engine output torque $T_{SET-3}$ is selected is that when the auxiliary air control valve 20 is controlled to change the amount $Q_a$ of air flow through the auxiliary air passage 22, the engine output torque changes after a delay of ½ cycle (360° of rotation of the engine crankshaft) for a 4-cycle engine. The fact that the new required engine output torque change $T_{SET}$ is satisfied can be checked after 360° of rotation of the engine crankshaft. Upon completion of this setting of the required engine output torque, the program proceeds to the end point 314 which corresponds to the point 212 of FIG. 2.

Figure 4:
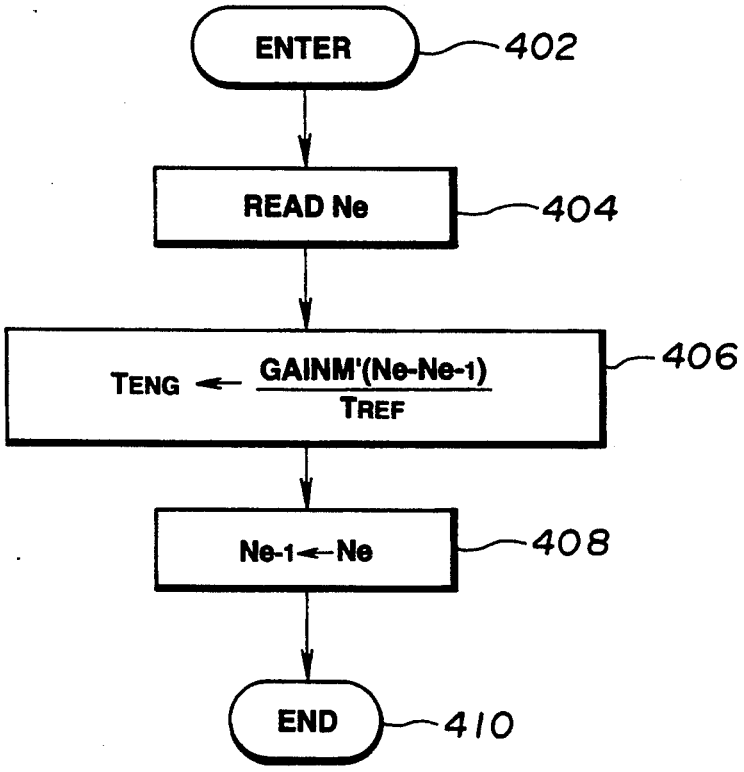
FIG. 4 is a detailed flow diagram for the digital computer as programmed for the calculation of actual engine output torque change.

FIG. 4 is a flow diagram illustrating the programming of the digital computer as it is used to calculate the actual engine output torque change $T_{ENG}$. At the point 402, which corresponds to the point 212 of FIG. 2, the computer program is entered. At the point 404 in the program, the engine speed $N_e$ is read into the computer memory. At the point 406 in the program, the actual engine output torque change $T_{ENG}$ per unit time is calculated as $T_{ENG}=\{GAINM'\cdot(N_e-N_{e-1})\}/T_{REF}$, where GAINM' is a constant used in converting an engine speed change into a corresponding torque, $N_e$ is the new engine speed value read or sampled at the point 404 in the present cycle of execution of the program and $N_{e-1}$ is the last engine speed value read or sampled at the point 404 in the last cycle of execution of the program. At the point 408 in the program, the new engine speed value $N_e$ is stored to update the last engine speed value $N_{e-1}$ for the calculation of actual engine output torque change $T_{ENG}$ at the point 406 in the next cycle of execution of the program. Following this, the program proceeds to the end point 410 which corresponds to the point 214 of FIG. 2.

According to the invention, the control unit calculates a basic engine output torque required to maintain the engine idling speed at a target value, and a required engine output torque change required to change the engine speed to a changed target engine idling speed value. A required engine output torque is calculated based upon the sum of the calculated basic engine output torque and a torque value corresponding to a deviation of a sensed engine output torque change from the required engine output torque change. The required engine output torque is used to control the amount of air permitted to enter the engine when the engine is idling. It is, therefore, possible to provide a fast response to an external load change and also to a target engine idling speed change.

What is claimed is:

1. An apparatus for controlling the idling speed of an internal combustion engine including a throttle valve provided in an induction passage for controlling the amount of air flow through the induction passage, and an auxiliary air control valve provided in an auxiliary air passage bypassing the throttle valve for controlling the amount of air flow through the auxiliary air passage, the apparatus comprising:

sensor means sensitive to engine speed for producing an electrical signal indicative of a sensed engine speed;

means for calculating a target value for engine idling speed as a function of engine temperature;

means for calculating a basic engine output torque required to maintain the engine speed at the calculated target value;

means for calculating a required engine output torque change required to change the engine speed to a changed target engine idling speed value;

means for calculating an actual engine output torque change;

means for calculating a required engine output torque based upon a sum of the calculated basic engine output torque and a torque value corresponding to a difference between the required engine output torque change and the calculated actual engine output torque change;

means for converting the required engine output torque into a corresponding amount of air flow through the auxiliary air passage; and means for controlling the auxiliary air control valve to permit the converted amount of air to flow through the auxiliary air passage.

2. The engine idling speed control apparatus as claimed in claim 1, wherein the converting means includes means for calculating the amount $Q_a$ of air flow through the auxiliary air passage as $Q_a=N_{SET}\times(T_{SET}-T_{ENG+Tpump})$, where $N_{SET}$ is the target engine idling speed value, $T_{SET}$ is the required engine output torque change, $T_{ENG}$ is the actual engine output torque change, and $T_{pump}$ is the basic engine output torque.

3. The engine idling speed control apparatus as claimed in claim 2, wherein the basic engine output torque calculating means includes means for calculating the basic engine output torque $T_{pump}$ as $T_{pump}=K1\times(N_{SET}/N_e-1)$ where K1 is a constant, and $N_e$ is the sensed engine speed.

4. The engine idling speed control apparatus as claimed in claim 2, wherein the required engine output torque change calculating means includes means for calculating the required engine output torque change $T_{SET}$ as $T_{SET}=K2\times(N_{SET}-N_{SET-1})/T_{REF}$, where K2 is a constant, $N_{SET}$ is a new value of target engine idling speed, $N_{SET-1}$ is a last value of target engine idling speed calculated a predetermined number of angles $T_{REF}$ of rotation of the engine crankshaft before the new target engine idling speed value is calculated.

5. The engine idling speed control apparatus as claimed in claim 2, wherein the actual engine output torque change calculating means includes means for calculating the actual engine output torque change $T_{ENG}$ as $T_{ENG}=K3\times(N_e-N_{e-1})/T_{REF}$, where K3 is a constant, $N_e$ is a sensed new engine speed value, $N_{e-1}$ is a last engine speed value sensed a predetermined number of angles $T_{REF}$ of rotation of the engine crankshaft before the new engine speed value is calculated.

* * * * *